US006710543B2

(12) United States Patent
Inoue et al.

(10) Patent No.: US 6,710,543 B2
(45) Date of Patent: Mar. 23, 2004

(54) EL ELEMENT, METHOD FOR FORMING EL ELEMENT, AND DISPLAY PANEL THAT USES EL ELEMENT

(75) Inventors: Takashi Inoue, Kuwana-gun (JP); Masayuki Katayama, Handa (JP); Hiroshi Kondo, Nagoya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/140,368

(22) Filed: May 8, 2002

(65) Prior Publication Data

US 2002/0167272 A1 Nov. 14, 2002

(30) Foreign Application Priority Data

May 9, 2001 (JP) ..... 2001-139244

(51) Int. Cl.[7] ..... H01J 1/62

(52) U.S. Cl. ..... 313/509; 313/506; 313/521; 216/5; 445/24

(58) Field of Search ..... 315/169.3, 169.1; 313/503, 506, 520, 521; 216/5, 34, 41, 53, 58, 76; 427/66; 428/690; 205/674; 445/24

(56) References Cited

U.S. PATENT DOCUMENTS

| | | | | |
|---|---|---|---|---|
| 4,486,487 A | | 12/1984 | Skarp | 428/216 |
| 5,084,131 A | * | 1/1992 | Inoue et al. | 216/5 |
| 5,688,551 A | * | 11/1997 | Littman et al. | 427/64 |
| 5,757,127 A | * | 5/1998 | Inoguchi et al. | 313/507 |
| 5,888,410 A | * | 3/1999 | Ishihara et al. | 216/5 |
| 5,917,278 A | * | 6/1999 | Miyauchi et al. | 313/506 |
| 5,993,637 A | * | 11/1999 | Hisamatsu et al. | 205/652 |
| 6,120,338 A | * | 9/2000 | Hirano et al. | 445/24 |
| 6,262,531 B1 | * | 7/2001 | Inoguchi et al. | 313/506 |

* cited by examiner

*Primary Examiner*—Haissa Philogene
(74) *Attorney, Agent, or Firm*—Posz & Bethards, PLC

(57) ABSTRACT

An EL element including a first electrode, a luminescent layer, an insulation layer, and a second electrode is laminated so that a short circuit between the first electrode and the second electrode at a defect of the insulation layer between the luminescent layer and the second electrode is prevented. A cavity 41 is formed in the layer 4 under an area 51 at which the second insulation layer 5 is missing. The second electrode 6 is separated by the cavity 41 from the first insulation layer 3 located under the luminescent layer 4 to prevent a short circuit.

13 Claims, 4 Drawing Sheets

EL ELEMENT, METHOD FOR FORMING EL ELEMENT, AND DISPLAY PANEL THAT USES EL ELEMENT

CROSS REFERENCES TO RELATED APPLICATIONS

This application relates to and incorporates by reference Japanese patent application No. 2001-139244 filed on May 5, 2001.

BACKGROUND OF THE INVENTION

The present invention relates to an EL (electroluminescence) element and a display panel fabricated by use of the EL element used for a self-luminescence type segment display or matrix display of an instrument or a display for various terminal apparatuses.

FIG. 5 shows a vertical cross sectional view of a conventional EL element in general use. The EL element is formed by laminating a first electrode 2, a first insulation layer 3, a luminescent layer 4, a second insulation layer 5, and a second electrode 6 laminated successively on an insulative substrate 1 such as a glass substrate. Furthermore, a counter glass substrate 8 is adhered with adhesive 7 on the EL element to form a display panel.

The insulation layers 3 and 5 are formed of silicone dioxide ($SiO_2$), silicone nitride (SiN), silicone oxide nitride (SiON), or tantalum pentoxide ($Ta_2O_5$) by means of sputtering or vapor deposition.

A method in which aluminum oxide ($Al_2O_3$) layers and titanium oxide ($TiO_2$) layers are laminated alternately by means of atomic layer epitaxy (referred to as ALE herein) to form the insulation layers 3 and 5 as the $Al_2O_3/TiO_2$ laminate-structured film has been proposed (refer to JP-A No. S58-206095).

In the case of the $Al_2O_3/TiO_2$ laminate-structured film, the $Al_2O_3$ layer serves as an insulation layer and the $TiO_2$ layer serves as a semiconductor layer, and the laminate structure comprising the insulation layer and the semiconductor layer forms a heavily insulative layer.

It is inevitable that the insulation layers 3 and 5 formed by sputtering, vapor deposition, or ALE contain some defects, or vacancies. As the result, it is difficult to provide a sufficient withstand voltage on all the areas of a display panel (EL display panel). Each area forms a plurality of EL elements for serving as a pixel.

EL display panels are usually screened as described herein to exclude panels with low withstand voltage. In detail, three layers, the first insulation layer 3, the luminescent layer 4, and the second insulation layer 5, are located between the first electrode 2 and the second electrode 6. Typically, EL display panels are designed so that a sufficient withstand voltage (life) exists as long as two layers remain, even if one of these three layers contains a defect (vacant area, or hole).

However, according to the study by the inventors of the present invention, it is difficult to guarantee a sufficient life for an EL display panel even though screening, as described above, is carried out, and it was found that short-circuits occurred between the first electrode 2 and the second electrode 6 within a relatively short time. The problem is described in detail with reference to FIG. 6A to FIG. 6C.

FIG. 6A to FIG. 6C, which show three cases, respectively, that may occur. FIG. 6A shows a case in which the second insulation layer 5 contains a defect. In this case, the second electrode 6 extends and is connected to the luminescent layer 4 through the defect of the second insulation layer 5, and two layers, namely the luminescent layer 4 and the insulation layer 3, remain between the electrodes 2 and 6.

FIG. 6B shows a case in which the first insulation layer 3 contains a defect. In this case, the luminescent layer 4 extends and is connected to the first electrode 2 through the defect of the first insulation layer 3, and two layers, namely the second insulation layer 5 and the luminescent layer 4, remain between the electrodes 2 and 6.

FIG. 6C shows a case in which the luminescent layer 4 contains a defect. Herein, the second insulation layer 5 extends and is connected to the first insulation layer 3 through the defect of the luminescent layer 4, and two layers, namely the second insulation layer 5 and the first insulation layer 3, remain between the electrodes 2 and 6.

These three cases may occur as described hereinabove, but according to the study by the inventors of the present invention, the lives of the displays of these three examples are different, and it was found that the life of the structure shown in FIG. 6A was significantly short in comparison with the other structures, experimentally.

In the case that the insulation layer 5 located between the luminescent layer 4 and the second electrode 6 in FIG. 6A contains a defect, it is important to avoid a short circuit between the first and second electrodes 2 and 6, for extending the life of the EL display panel.

The present invention has been accomplished in view of the problem found in the study conducted by the inventors of the present invention, and it is the object of the present invention to prevent short circuit between the first electrode and the second electrode through the defect of the insulation layer located between the luminescent layer and the second electrode of an EL element.

SUMMARY OF THE INVENTION

The invention is basically an EL element including a first electrode, a luminescent layer, and an insulation layer, and a second electrode. A defect hole is formed in the insulation layer. The layers are laminated successively on an insulative substrate. A cavity is formed in the luminescent layer under the defect hole, and the second electrode is separated from a layer located under the luminescent layer by the cavity.

The invention is further a method for forming an EL element in which at least a first electrode, a luminescent layer, an insulation layer, and a second electrode are laminated successively on an insulative substrate. The method includes laminating the layers on the insulative substrate and exposing the luminescent layer to etchant.

DETAILED DESCRIPTION OF THE PREFERRED EMBODIMENTS

First Embodiment

Figure 1:
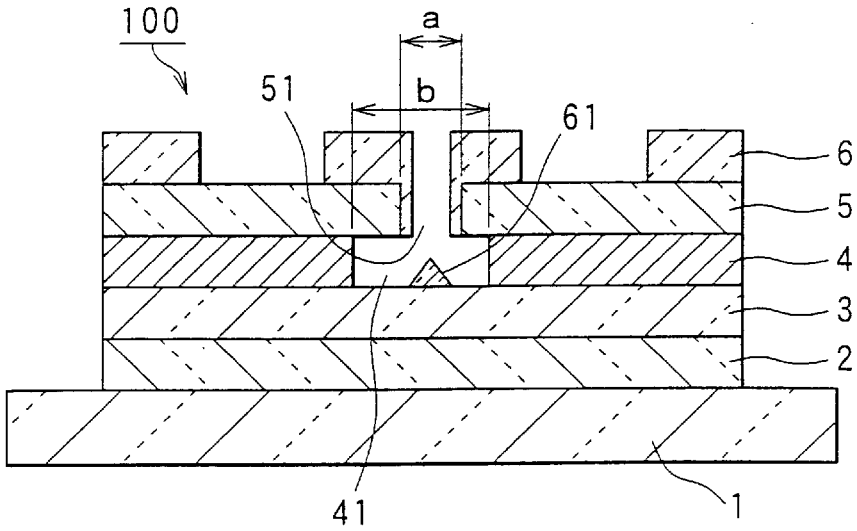
FIG. 1 is a schematic vertical cross sectional diagram showing the structure of an EL element in accordance with the first embodiment of the present invention.

An embodiment of the present invention will be described in detail with reference to the drawings. FIG. 1 is a schematic diagram showing the vertical cross sectional structure of an EL element 100 in accordance with the first embodiment of the present invention. The EL element 100 is formed by laminating a first electrode 2, a first insulation layer 3, a luminescent layer 4, a second insulation layer 5, and a second electrode 6 successively on an insulative substrate 1 consisting of glass substrate.

The insulative substrate 1 consists of glass substrate in the present example. The first electrode 2 comprises an optically transparent conductive film such as ITO (indium oxide/tin) film or ZnO (zinc oxide) film. In the present example, the first electrode 2 consisting of ITO film is formed in the stripe configuration that extends in the right and left direction in the plan view.

The first insulation layer 3 consisting of metal oxide film formed by means of sputtering technique or vapor deposition technique is formed above the first electrode 2 on the space between first electrodes 2, and covers these areas. The first insulation layer 3 preferably consists of insulation film containing at least four elements, namely tantalum, tin, nitrogen, and oxygen (TaSnON film) and is formed by sputtering in the present example.

The luminescent layer 4, which consists of inorganic material, is formed by vapor deposition. Zinc sulfide (ZnS) is used as the mother material and ZnS, to which Mn is added as the luminescence center (ZnS:Mn), is used in the present example, but ZnS mother material with terbium (Tb) added as the luminescence center (ZnS:Tb), or strontium sulfide (SrS) mother material with cerium (Ce) added as the luminescence center (SrS:Ce) may be used to emit various colors.

The second insulation layer 5 is laminated on the luminescent layer 4 and covers the luminescent layer 4. The second insulation layer 5 may consist of $Al_2O_3/TiO_2$ laminate-structured film (referred to as ATO film hereinafter) or $Al_2O_3$ film formed by means of ALE. ATO film is employed in the present example.

The second electrode 6 may be formed by the material of the first electrode 2. In the present example, the second electrode 6 consists of ITO film and is formed in a stripe configuration to be orthogonal to the first electrode 2 in the plan view. Spots where the electrodes 2 and 6 are overlapped serve as luminescent pixels.

In the present embodiment, a unique structure as shown in FIG. 1 is applied so that short circuit between the electrodes 2 and 6 of the EL element containing a defect 51, or hole, does not occur at the defect 51. The defect exists in the second insulation layer 5 located between the luminescent layer 4 and the second electrode 6.

In detail, a cavity 41 in the luminescent layer 4 is formed under the area where the second insulation layer 5 is missing (namely, the defect 51), the second electrode 6 is separated from the first insulation layer 3 located under the luminescent layer 4 due to the cavity 41. In the present example, the diameter of the cavity 41 is denoted by b and the diameter a of the defect 51 of the second insulation layer 5 is denoted by a, and the relation a<b is assumed.

Figure 5:
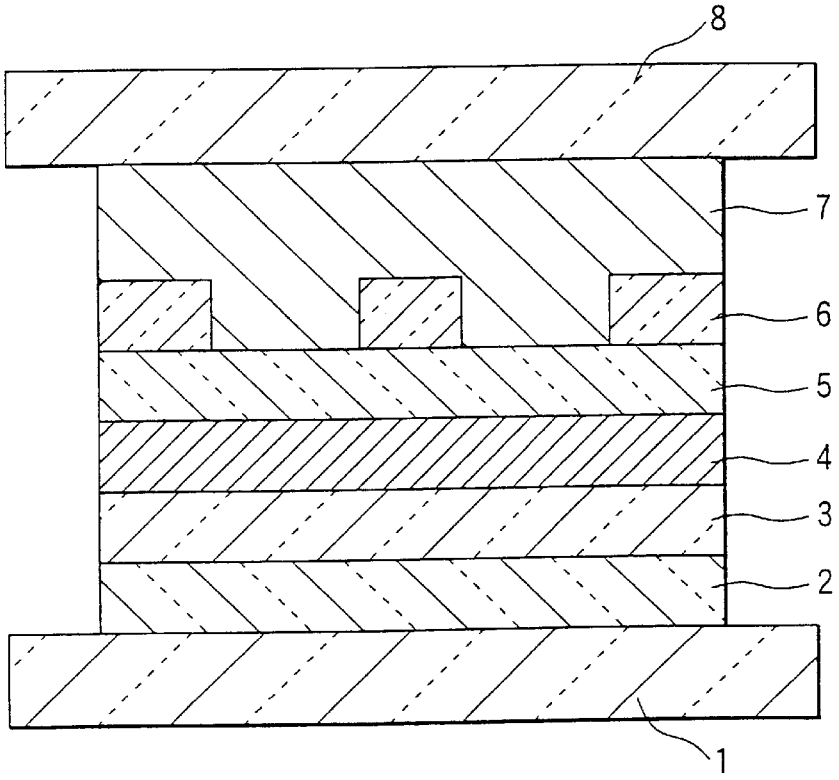
FIG. 5 PRIOR ART
FIG. 5 is a schematic vertical cross sectional diagram showing the structure of a conventional EL element that has been used generally.

Furthermore, though it is not shown in the drawing, a counter glass substrate is adhered on the second electrode 6 with adhesive, as in the case of FIG. 5, to form a display panel. Thermosetting resin or epoxy resin is used as the adhesive.

In the case of the EL element 100 having the above-mentioned structure, a rectangular wave voltage (driving voltage) is applied between the first and second electrodes 2 and 6 to activate the luminescent layer 4 to emit light. Because layers located above and under the luminescent layer 4 are optically transparent, the light emitted from the luminescent layer 4 may exit from the insulative substrate 1 side and also from the second electrode side.

Otherwise, the light can exit from only the side of the insulative substrate 1 or the side of the second electrode 6. That is, at least the side from which the light exits may be formed of a transparent layer out of the electrodes 2 and 6 and the insulation layers 3 and 5, for example, the electrode located opposite to the side from which the light exits may be an electrode that is not transparent. If high reflectance material is used for the electrode, a display device that emits more light will result.

Next, a method for fabrication of the EL element 100 in the present example will be described. At first, an ITO film having, for example, a thickness of 200 nm to 1000 nm is formed on an insulative substrate 1 consisting of glass substrate as the first electrode 2 by means of sputtering. A TaSnON film is formed on the substrate 1 as the first insulation layer 3 by sputtering.

A method for forming the TaSnON film is described in detail. A material formed by adding 1 to 20 mol % (preferably 5 to 10 mol %) of SnO to $Ta_2O_3$ is used as a sputtering target. In the method, the film is formed by means of reaction sputtering technique at RF (high frequency) with sputtering gas of argon to which oxygen and nitrogen are added.

At that time, more nitrogen than oxygen is introduced. More preferably, the proportion of the gas flow rate of nitrogen is twice or more in comparison with that of oxygen. According to the method described above, a TaSnON film having a thickness of, for example, 300 nm to 1000 nm is formed as the first insulation layer 3.

Next, a luminescent layer 4 having a thickness of, for example, 700 to 1200 nm consisting of ZnS:Mn is formed on the first insulation layer 3 by means of vapor deposition, and an ATO film is formed on the luminescent layer 4 by means of ALE as the second insulation layer 5. A method for forming an ATO film will be described in detail below.

In the first step, an $Al_2O_3$ layer is formed by ALE (Atomic Layer Epitaxy) by use of aluminum trichloride ($AlCl_3$) as the material for generating aluminum (Al) and water ($H_2O$) as the material for generating oxygen (O).

Because one atomic layer is formed in one ALE technique, the material gases are fed alternately. Therefore, in this case, $AlCl_3$ is introduced for one second into a reactor with argon (Ar) carrier gas and the the $AlCl_3$ gas in the reactor is purged.

Next, $H_2O$ is introduced into the reactor for one second with Ar carrier gas in the same manner as used in the case of $AlCl_3$, and then the $H_2O$ is purged from the reactor. In the first step, the cycle is repeated to form an $Al_2O_3$ layer having the desired thickness.

In the second step, a titanium oxide ($TiO_2$ ) layer is formed by ALE by use of titanium tetrachloride ($TiCl_4$) as the material for generating titanium (Ti) and $H_2O$ as the material for generating oxygen.

In detail, $TiCl_4$ is introduced into the reactor with argon (Ar) carrier gas for one second, and the $TiCl_4$ is then purged from the reactor. Next, $H_2O$ is introduced into the reactor for one second with argon carrier gas, and the $H_2O$ is then purged. In the second step, the cycle is repeated to form a $TiO_2$ film having the desired thickness.

The first step and the second step are repeated to form the ATO film with a desired film thickness, and the film serves as the second insulation layer 5. In detail, the thickness of each $Al_2O_3$ layer is 5 nm and the thickness of each $TiO_2$ layer is 5 nm, and thirty layers of each are laminated to form the structure. The first layer and the final layer of the ATO film may be an $Al_2O_3$ layer or a $TiO_2$ layer.

Considering the withstand voltage, the thickness of each $Al_2O_3$ layer and of each $TiO_2$ layer of the second insulation layer (ATO film) 5 is in a range from 0.5 nm to 100 nm (preferably from 1 nm to 10 nm). If the film thickness per layer is less than 0.5 nm, the layer does not function as an insulation layer, and on the other hand if the film thickness per layer is greater than 100 nm, the withstand voltage improvement effect due to the laminate structure saturates, and the further advantage cannot be obtained.

After the second insulation layer 5 is formed as described hereinabove, an ITO film having a thickness of, for example, 100 nm to 500 nm is formed thereon by means of sputtering technique as the second electrode 6. Furthermore, a counter glass substrate is adhered thereon with interposition of the adhesive to form a display panel to thereby complete an EL element 100 shown in FIG. 1.

In the case of a dot matrix display device provided with EL elements, 1000 or more EL elements, each of which serves as a pixel, are arranged, for example, in the matrix fashion to from a display panel. In the case that EL elements are fabricated based on the above-mentioned fabrication method, it is very difficult to obtain an EL display panel without any defective element.

For example, in an $Al_2O_3/TiO_2$ laminate structure, the withstand voltage is usually high in the voltage application direction (lamination direction) of an EL element, but the withstand voltage is low in the horizontal direction that is orthogonal to the voltage application direction (both directions of a layer) in comparison with a usual insulation layer that is formed by means of sputtering. In other words, generally the defect is not a point defect that causes poor insulation in the voltage application direction of an EL element but is a linear defect.

Based on the above-mentioned screening processing, if two or more layers out of three layers including the first insulation layer 3, the luminescent layer 4, and second insulation layer 5, which relate to the withstand voltage of the EL element 100, are eliminated, the EL element does not function as an EL element and a display panel cannot be formed because of the type of defect. Thus, the three examples that do not have one layer shown in FIG. 6 were studied.

Figure 6A:
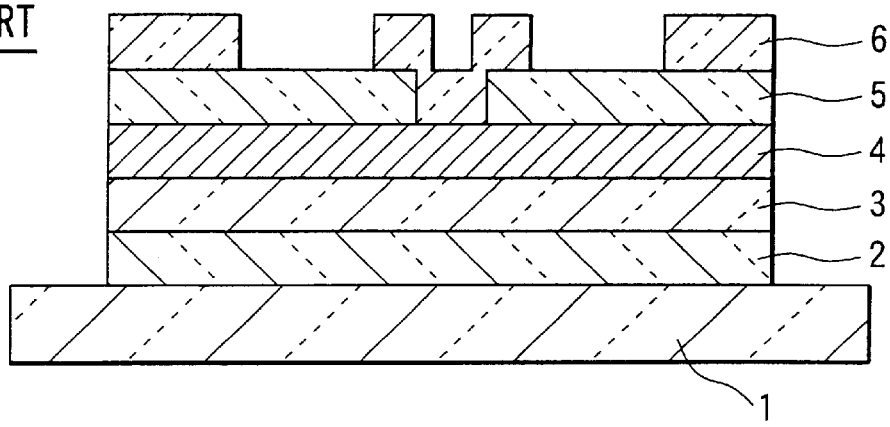
FIG. 6A RELATED ART
FIG. 6A is a schematic vertical cross sectional diagram showing a defect of an EL element.
Figure 6B:
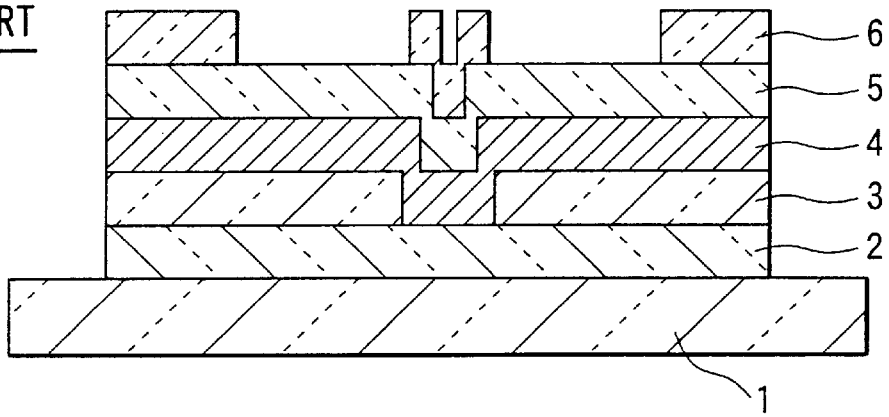
FIG. 6B RELATED ART
FIG. 6B is a schematic vertical cross sectional diagram showing another defect of an EL element.
Figure 6C:
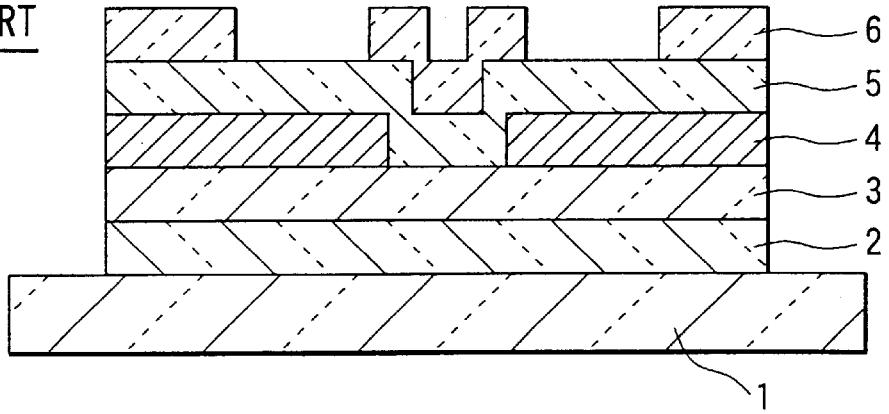
FIG. 6C RELATED ART
FIG. 6C is a schematic vertical cross sectional diagram showing another defect of an EL element.

As the result of the study, the time required for occurrence of insulation failure of each structure shown in FIG. 6A to FIG. 6C (short circuit between the first electrode 2 and the second electrode 6) is different for respective structures, and the ratio of the time is 1:7:12 in the order from FIGS. 6A, 6B, to 6C. Though the time required for occurrence of insulation failure significantly depends on the driving voltage, driving frequency, and operation temperature of an EL display panel, the ratio of the time required for occurrence of insulation failure of each structure remains constant as described hereinabove.

From the result, it is found that the life of the structure shown in FIG. 6A is very short in comparison with other structures. Therefore, it is found that it is effective to improve the structure shown in FIG. 6A in the case that the life of a display panel is insufficient.

To improve the life, the cavity 41 is formed in the luminescent layer 4 located under the defect of the second insulation layer 5 to separate the second electrode 6 from the first insulation layer 3 as described above (refer to FIG. 1). The structure is formed as shown in FIG. 2A to FIG. 2C by use of an EL element having a defect on the second insulation layer 5 among the three layers including the first insulation layer 3, the luminescent layer 4, and the second insulation layer 5.

Figure 2A:
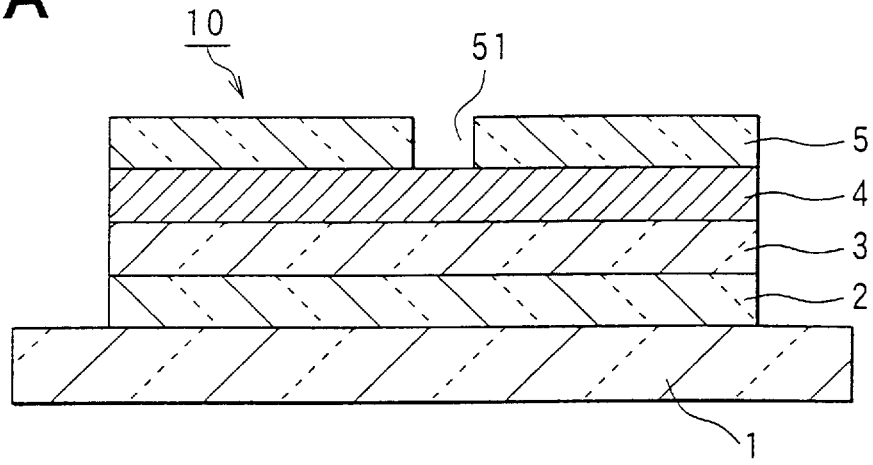
FIG. 2A is a schematic cross sectional view showing part of a step of a process for forming a cavity of a luminescent layer.
Figure 2B:
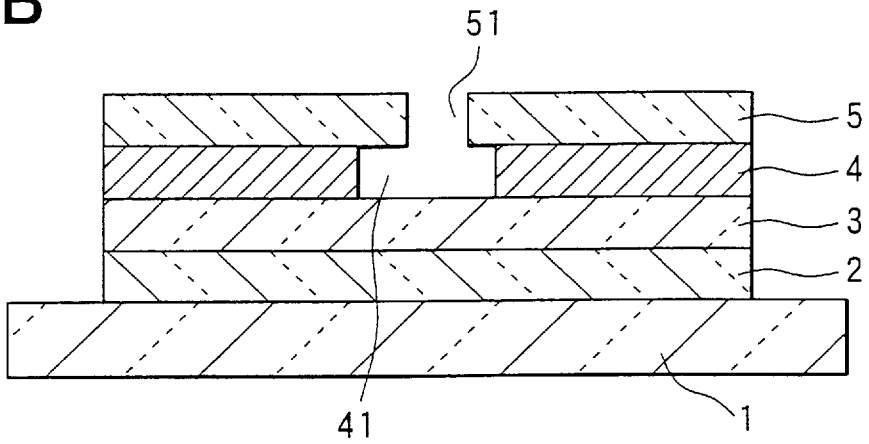
FIG. 2B is a schematic cross sectional view showing a step of a process for forming a cavity of a luminescent layer subsequent to FIG. 2A.
Figure 2C:
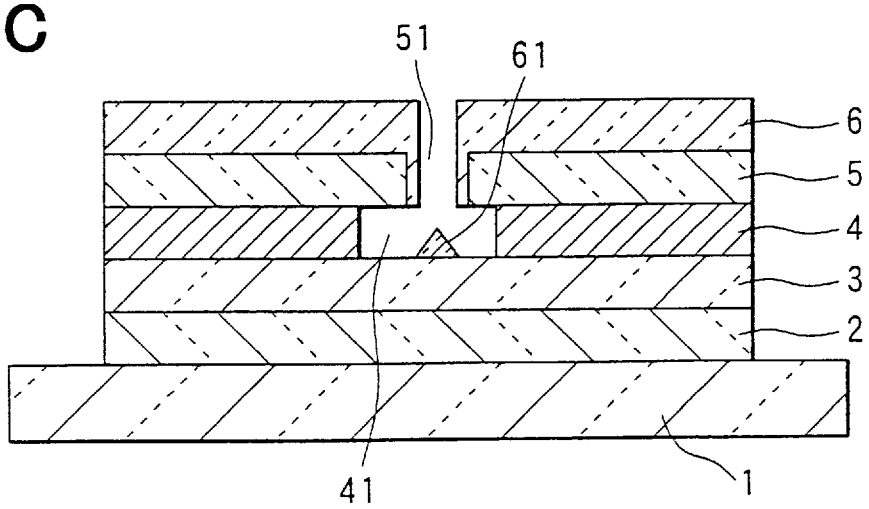
FIG. 2C is a schematic cross sectional view showing a step of a process for forming a cavity of a luminescent layer subsequent to FIG. 2B.

FIG. 2A to FIG. 2C are schematic cross sectional views showing a method for forming the cavity 51 of the luminescent layer 4 in accordance with the present invention. At first, as shown in FIG. 2A, in the laminate 10 formed by laminating the layers from 2 to 5 (second insulation layer 5) successively on the insulative substrate 1 according to the above-mentioned fabrication method, the second insulation layer 5 contains a defect 51 among the three layers including the first insulation layer 3, the luminescent layer 4, and the second insulation layer 5.

The defect 51 is an area where the second insulation layer 5 is not formed (partial lack of the film), and in some cases conductive foreign matter consisting of metal is in the defect 51.

Next, as shown in FIG. 2B, the luminescent layer 4 of the laminate 10 is exposed to etchant. In detail, the top of the laminate 10 is dipped in etchant so that the etchant penetrates from the defect 51, the luminescent layer 4 is exposed to the etchant and etched, and the cavity 41 is formed just under the defect 51. The diameter of the cavity 41 is denoted by b and the diameter of the defect 51 of the second insulation layer 5 is denoted by a, and the relation $a<b$ is assumed.

Herein, an acid solution is employed as the etchant, and a liquid containing hydrochloric acid and nitric acid (aqua regia) may be employed preferably. At that time, the first and second insulation layers are both not etched by the liquid that contains hydrochloric acid and nitric acid. In detail, because the first and the second insulation layers 3 and 5 consist of oxide-base material, the first and the second insulation layers 3 and 5 do not accept etching with the acid solution physically and, on the other hand, the luminescent layer 4 consisting of sulfide-base material accepts etching easily. The above-mentioned procedure is based on the matching between the material of the respective layers 3 and 4 and the etchant. Furthermore, the etchant can penetrate into the luminescent layer 4 in the horizontal direction, and it is possible to clean it sufficiently with water after completion of the etching.

Because the etching time varies depending on the temperature and composition of the liquid and the material and film thickness of the luminescent layer 4, the relation between the diameter b of the cavity 51 and the diameter a of the defect 51 of the second insulation layer 5 is set so as to satisfy the relation $a<b$ depending on the case. For example, the relation between the etching time (which has an arbitrary unit) and the diameter b (pinhole diameter, which has an arbitrary unit) of the cavity 41 was measured and the result as shown in FIG. 3 was obtained.

The methods for measuring the diameter b include a method in which a plurality of samples shown in FIG. 2A are prepared, and the diameter b of the cavity 41 is measured by use of a microscope from time to time during etching for the same sample while the sample is being soaked in the etchant. The etching time assigned to the abscissa of FIG. 3 represents the total time a sample is soaked in the etchant.

Figure 3:
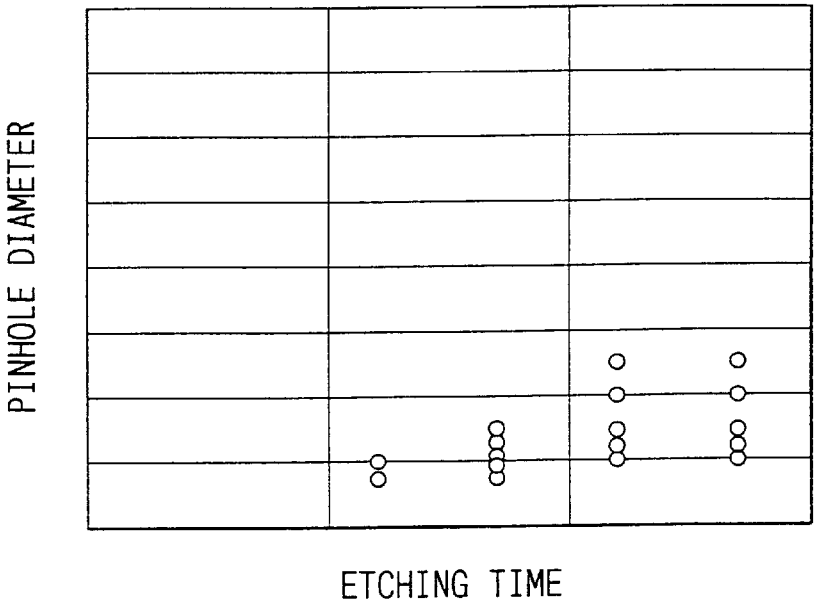
FIG. 3 is a diagram showing the relation between the etching time (arbitrary unit) and the cavity diameter (pinhole diameter, arbitrary unit).

As shown in FIG. 3, the diameter b (pinhole diameter) of the cavity 41 saturates and remains constant in the region where the etching time exceeds a certain time. On the assumption that the time when the diameter b becomes a certain value is considered to be the etching time, the luminescent layer 4 located under the defect 51 is removed and the cavity 41 is formed to satisfy the relation a<b as shown in FIG. 2B.

In the case that the defect 51 of the second insulation layer 5 is a portion that contains a conductive foreign material in the layer, the conductive foreign material consisting of metal is removed by etching according to the method shown in FIG. 2A and FIG. 2B. Therefore, even in such case, the structure shown in FIG. 2B can be obtained.

Thereafter, the second electrode 6 is formed, at that time, the material of the second electrode 6 does not extend to the first insulation layer 3 located under the luminescent layer 4 due to the presence of the cavity 41 located just under the defect 51 as shown in FIG. 2C. A part of the material of the second electrode 6 that is separated from the second electrode 6 remains on the first insulation layer 2.

The first insulation layer 3 is located separately from the second electrode 6 as described above. Then, the second electrode 6 is patterned by means of photolithography to form the structure shown in FIG. 1.

Thirty-five of the structures shown in FIG. 1, in which the relation a<b between the diameter b of the cavity and the diameter a of the defect 51 of the second insulation layer 5 was satisfied, were prepared. In each structure, the second electrode 6 did not extend to the first insulation layer 3 at the defect 51 of the second insulation layer 5. This fact suggests that the probability of conductive connection between the first and second electrodes 2 and 6 is suppressed to a value of 4% or less at the reliability of 50%.

In the case that the relation a≧b is satisfied between the diameter b of the cavity and the diameter a of the defect 51 of the second insulation layer 5, the structure shown in FIG. 1 can be realized. However, the probability of conductive connection of the second electrode 6 to the first insulation layer 3 increases with a decrease in the proportion of the diameter b to the diameter a in the case of the relation a≧b in comparison with the case of the relation a<b, though the probability depends on the electrode material.

Based on the above, as long as the relation a<b is satisfied, as in the present example, the second electrode 6 is formed separately from a layer located under the luminescent layer (first insulation layer 3) easily, and a short circuit between the first and second electrodes 2 and 6 is prevented more reliably.

Furthermore, even in the case that the second electrode 6 is connected conductively to the first insulation layer 3 in the method shown in FIG. 2A to FIG. 2C, for example, a voltage of 150 volts or higher is applied only on the first insulation layer. As a result, insulation failure occurs in the inspection process of the EL display panel, and the EL display panel with insulation failure is screened. Thus, a short life display panels are excluded before shipment.

Furthermore, as shown in FIG. 3, the diameter b of the portion (cavity 41) of the luminescent layer 4 that is etched saturates at a certain etching time. The saturated dimension of the diameter b depends on the diameter of the defect 51 of the second insulation layer 5. For example, in the case that the second insulation layer 5 is formed by means of ALE technique, the dimension of the diameter a of the defect 51 is 5 μm or smaller, usually.

At that time, the dimension of the diameter b of the cavity 41 of the luminescent layer 4 is 50 μm or smaller. Because a human eye cannot recognize a non-luminous area in a pixel when an EL element emits light if the configuration of one pixel of a display panel is a square having a side larger than 100 μm, the function of the display panel is not disturbed.

As described hereinbefore, according to the first embodiment a cavity 41 where the luminescent layer 4 is not formed is formed under the defect 51 of the second insulation layer 5, and the second electrode 6 is formed separately from the first insulation layer 3 located under the luminescent layer 4 with interposition of the cavity 41 by means of the method shown in FIG. 2A to FIG. 2C.

Thus, a short circuit between the first electrode 2 and the second electrode 6 at the defect 51 is prevented, and the present invention provides an EL display panel that provides not only long dielectric breakdown life but also the display panel function.

Second Embodiment

Though the second insulation layer is formed by ALE, the first insulation layer 3 is formed by sputtering or vapor deposition that is carried out in a shorter time than the ALE technique to shorten the process time in the first embodiment. However, the first insulation layer 3 and the second insulation layer 5 may both be ATO film formed by ALE.

In the case of three examples shown in FIG. 6A to FIG. 6C, the time is required for causing insulation failure of each structure, and the time ratio was 1:6:20 in the order FIGS. 6A, 6B, 6C. In this case, though the time required for causing insulation failure depends largely on the driving voltage, driving frequency, and operating temperature of the EL display panel, the ratio of the time required for causing insulation failure of each structure remains constant as described hereinabove.

Therefore, also in the present embodiment, in the case that a defect 51 is formed in the second insulation layer 5, a cavity 41 may be formed in the luminescent layer 4 located under the defect 51 of the second insulation layer 5 to separate the second electrode 6 from the first insulation layer 3.

Thus, a short circuit between the first electrode 2 and the second electrode 6 at the defect 51 is prevented, and the present invention provides an EL display panel that provides not only long dielectric breakdown life but also the display panel function.

Third Embodiment

Because the second electrode 6 is separated from a layer located under the luminescent layer 4 and short circuit between the first and second electrodes 2 and 6 is prevented, it is apparent that the above-mentioned effect is similarly applied to cover not only the case in which the first insulation layer 3 is interpolated between the first electrode 2 and the luminescent layer 4 but also the case in which the first insulation layer 3 is not interpolated.

Figure 4:
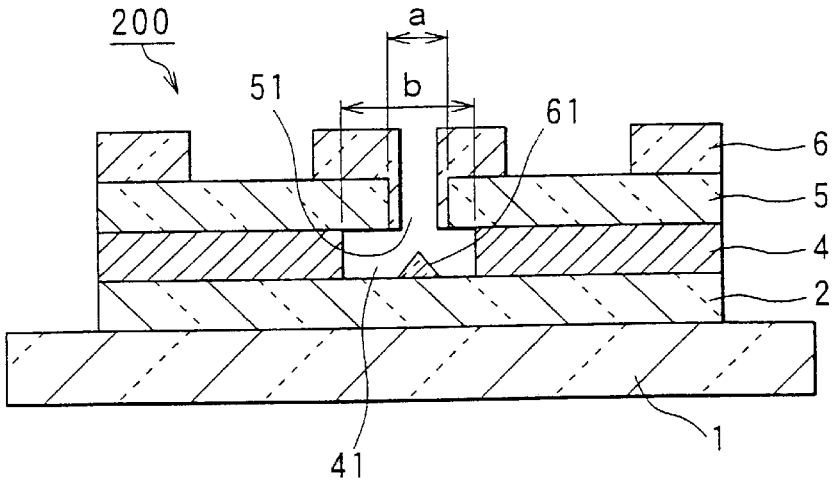
FIG. 4 is a schematic vertical cross sectional diagram showing the structure of an EL element in accordance with the third embodiment of the present invention.

FIG. 4 is a diagram showing the schematic vertical cross sectional structure of an EL element 200 in accordance with the third embodiment. The EL element 200 is formed by laminating a first electrode 2, a luminescent layer 4, a second insulation layer 5, and a second electrode 6 successively on an insulative substrate 1. An ATO film is preferably used as the second insulation layer 5 from the viewpoint of humidity resistance and film withstand voltage.

In the case of this structure, though the EL element is rendered sufficiently resistant to a high voltage with only the second insulation layer 5 if the luminescent layer 4 is defective, but the EL element is not rendered sufficiently resistant to a high voltage if the second insulation layer 5 is defective.

To avoid this problem in the present embodiment, in the case that the second insulation layer 5 is defective, a cavity 41 is formed in the luminescent layer 4 located under the defect 51 of the second insulation layer 5 to separate the second electrode 6 from a layer located under the luminescent layer 4 (first electrode 2). Thus, the effect obtained in the first embodiment will result. Furthermore, also in this case, it is preferred that the relation between the diameter b of the cavity 41 and the diameter a of the defect 51 of the second insulation layer is a<b.

It is apparent that the structure of the present embodiment can be formed based on the method described in the first embodiment.

What is claimed is:

1. An EL element comprising:

a first electrode;

a luminescent layer;

an insulation layer, wherein a defect hole is formed in the insulation layer; and a second electrode laminated successively on an insulative substrate wherein a cavity is formed in the luminescent layer under the defect hole, and the second electrode is separated from a layer located under the luminescent layer by the cavity.

2. The EL element according to claim 1, wherein the insulation layer is an upper insulation layer, and a lower insulation layer is laminated between the first electrode and the luminescent layer.

3. The EL element according to claim 2, wherein the lower insulation layer is a sputtered layer.

4. The EL element according to claim 1, wherein a diameter of the cavity is larger than a diameter of the defect hole.

5. The EL element according to claim 4, wherein the insulation layer is an upper insulation layer, and a lower insulation layer is laminated between the first electrode and the luminescent layer.

6. The EL element according to claim 5, wherein the lower insulation layer is a sputtered layer.

7. The EL element according to claim 1, wherein the insulation layer comprises an $Al_2O_3/TiO_2$ laminate-structured film.

8. The EL element according to claim 7, wherein the insulation layer is an upper insulation layer, and a lower insulation layer is laminated between the first electrode and the luminescent layer.

9. The EL element according to claim 8, wherein the lower insulation layer is a sputtered layer.

10. The EL element according to claim 9, wherein the EL element is part of a display panel.

11. A method for forming an EL element in which at least a first electrode, a first insulation layer, a luminescent layer, a second insulation layer, and a second electrode are laminated successively on an insulative substrate, the method comprising:

laminating the first electrode, the first insulation layer, the luminescent layer, and the second insulation layer successively on the insulative substrate, wherein a defect hole is formed in the second insulation layer; and exposing the luminescent layer to etchant that enters through the defect hole of the second insulation layer so that a cavity is formed in a portion of the luminescent layer, wherein the cavity is substantially surrounded by the first insulation layer, the second insulation layer, and the luminescent layer, and wherein a diameter of the cavity is larger than a diameter of the defect hole.

12. The method according to claim 11, wherein a liquid containing nitric acid and hydrochloric acid is used as a liquid for etching the luminescent layer.

13. The method according to claim 11, further comprising: laminating the second electrode successively on the second insulation layer after the luminescent layer is exposed to the etchant and the cavity is formed, wherein the second electrode is separated from the first insulation layer, which is located under the luminescent layer, by the cavity.

* * * * *